US005678814A

United States Patent [19]

Yokoyama et al.

[11] Patent Number: 5,678,814

[45] Date of Patent: Oct. 21, 1997

[54] SHEET FEEDING APPARATUS HAVING A FEEDING TRAY AND PAPER FEEDING METHOD

[75] Inventors: Chujiro Yokoyama, Toyokawa; Haruhiko Hori, Okazaki, both of Japan

[73] Assignee: Minolta Co., Ltd., Osaka, Japan

[21] Appl. No.: 544,106

[22] Filed: Oct. 17, 1995

[30] Foreign Application Priority Data

Oct. 20, 1994 [JP] Japan ..... 6-282749

[51] Int. Cl.[6] ..... B65H 3/44

[52] U.S. Cl. ..... 271/9.05; 271/9.11; 271/117; 271/126; 271/127; 271/157

[58] Field of Search ..... 271/9.05, 9.11, 271/118, 117, 122, 126, 127, 157

[56] References Cited

U.S. PATENT DOCUMENTS 4,925,177 5/1990 Nakamura et al. .

5,391,009 2/1995 Stodder .

FOREIGN PATENT DOCUMENTS 62-115179(A) 5/1987 Japan .

5105275 4/1993 Japan ..... 271/9.05

687543 3/1994 Japan ..... 271/9.05

*Primary Examiner*—David H. Bollinger

*Attorney, Agent, or Firm*—Burns, Doane, Swecker & Mathis, LLP

[57] ABSTRACT

A sheet feeding apparatus has a plurality of sheet trays each of which stores sheets to be fed. The sheet stored in the sheet trays is brought to a sheet feeding position by a plurality of sheet positioning mechanisms corresponding to the sheet trays, and is fed, one by one, at the sheet feeding position by a plurality of sheet feeding mechanisms corresponding to the sheet trays. Further, the sheet feeding apparatus has a motor which drives one of the sheet positioning mechanisms and the one of the sheet feeding mechanisms which corresponds to a sheet tray different from the sheet tray corresponding to the sheet feeding mechanism driven by the motor.

15 Claims, 9 Drawing Sheets

SHEET FEEDING APPARATUS HAVING A FEEDING TRAY AND PAPER FEEDING METHOD

BACKGROUND OF THE INVENTION

1. Field of the Invention

This invention relates to a sheet feeding apparatus having a feeding tray and a paper feeding method.

2. Description of the Related Art

Conventionally, a sheet feeding apparatus is provided in which a plurality of copying paper loaded on a paper feeding tray are adequately pressed against a paper feeding means such as a roller arranged above the paper feeding tray by raising a copying paper loading plate provided inside a paper feeding tray, and the copying paper is fed, sheet by sheet, in order from the uppermost layer. Further, a sheet feeding apparatus is also provided that has a plurality of paper feeding trays in which load their respective different sizes of copying paper to allow a desired copying paper size to be selected and then fed and feeds copying paper from a paper feeding tray selected by an input operation of the operator.

For example, a sheet feeding apparatus is disclosed in U.S. Pat. No. 4,925,177 which has a plurality of paper feeding trays stacked in multiple levels and in which a copying paper loading plate inside a selected paper feeding tray is pressed upward from below by a push-up lever to set the leading edge (paper feed opening side) of the copying paper to an adequate height and then using a group of paper feeding rollers close to the paper feed opening to feed the copying paper inside the paper feeding tray, sheet by sheet, in order from the uppermost layer.

In a conventional sheet feeding apparatus as described above, a push-up motor to drive the means (for example a push-up lever) to raise the copying paper loading plate inside the paper feeding tray and a paper feeding motor to drive the means (for example a paper feeding roller) to feed the copying paper are both necessary resulting in increased cost.

Moreover, in a sheet feeding apparatus having a plurality of paper feeding trays, a further problem exists in that if the number of paper feeding trays is increased, the number of push-up motors and paper feeding motors will increase by that amount thereby increasing the cost even more. In particular, an another problem also exists in which when each paper feeding tray is arranged in multiple levels to be stacked above and below each other, the size of each level (space occupied by each paper feeding tray) becomes larger due to the push-up motor and paper feeding motor increasing the overall size of the sheet feeding apparatus.

SUMMARY OF THE INVENTION

In view of the above problems, the object of this invention is to realize lower cost and smaller sized sheet feeding apparatus by means of reducing the number of motors required in a sheet feeding apparatus having a feeding tray.

To realize the above object, a sheet feeding apparatus comprises a plurality of sheet trays each of which stores sheets to be fed, a plurality of sheet positioning mechanisms corresponding to said sheet trays, which brings the sheets stored in said sheet trays to a sheet feeding position, a plurality of sheet positioning mechanisms corresponding to said sheet trays, which feeds, one by one, the sheets positioned at said sheet feeding position by said positioning mechanisms, and a motor which drives one of said sheet positioning mechanisms and the one of said sheet feeding mechanisms which corresponds to a sheet tray different from the sheet tray corresponding to the sheet feeding mechanism driven by said motor.

With this sheet feeding apparatus, the number of motors required is reduced, thereby achieving lower cost and smaller sized sheet feeding apparatus.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Referring to the accompanying drawings the first embodiment of this invention will be described at first.

The paper feeder of this embodiment comprises two levels of upper and lower paper feeding trays in which are loaded various different sizes of copying paper and is used by connecting it to an image forming apparatus such as a copying machine. The paper feeder of this embodiment selectively feeds copying paper from either an upper level feeding tray or a lower level feeding tray based on control signals from the image forming apparatus. An image is formed on the fed copying paper using a known process in the image forming apparatus.

Figure 1:
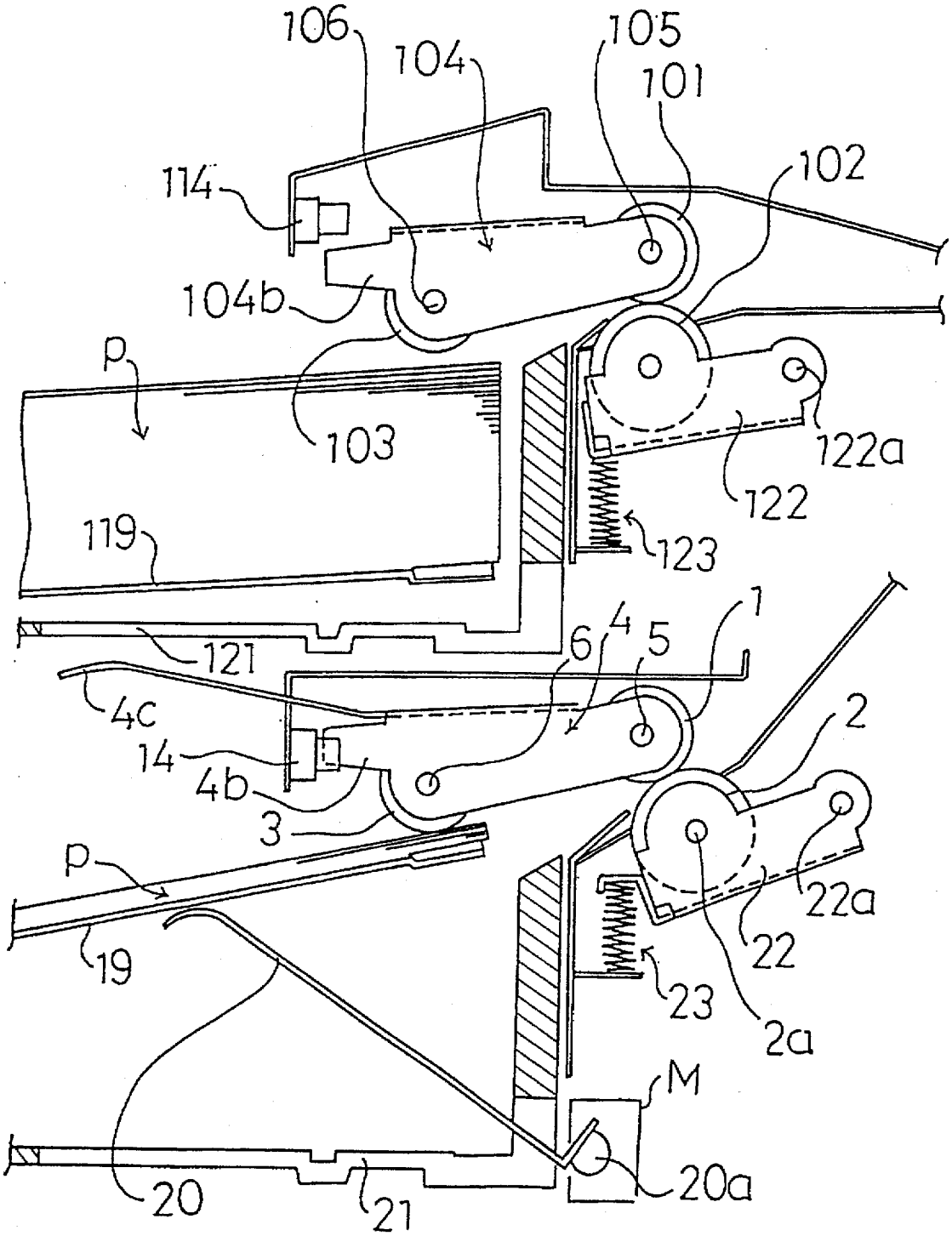
FIG. 1 is a model view showing the overall construction of the paper feeder of the first embodiment. This figure shows a state in which lower level feeding tray 21 is selected.

FIG. 1 is a front view showing the overall construction of the paper feeder of this embodiment. This paper feeder is connected to an image forming apparatus such as a copying machine (not shown in the figure) at the right side of the figure.

In FIG. 1, 21 is the lower level feeding tray and 121 is the upper level feeding tray.

When the lower level feeding tray 21 is selected, a plurality of copying paper P loaded on a copying paper loading plate 19 inside the lower level feeding tray 21 are manipulated by a supply roller 1 and a separation roller 2 after being drawn up by a pick-up roller 3 and then only the uppermost sheet of copying paper is sent to the feed path in the image forming apparatus. On the other hand, when the upper level feeding tray 121 is selected, a plurality of copying paper P loaded in a copying paper loading plate 119 inside the upper paper feeding tray 121 are manipulated by a supply roller 101 and a separation roller 102 after being drawn up by a pick-up roller 103 and then only the uppermost sheet of copying paper is sent to the feed path of the image forming apparatus.

The push-up means of the lower level feeding tray 21 comprises a copying paper loading plate 19 at the lower portion of this tray and a push-up lever 20 underneath this plate. The copying paper loading plate 19 is pushed up and maintained at an optimum height by the push-up lever 20 which passes through a long opening provided on the bottom of the lower level feeding tray 21 (not shown in the figure) (long opening extending in the left to right direction of FIG. 1) and is made to rotate in the clockwise direction. This push-up lever 20 is fixed to a rotating shaft 20*a* which is rotated by a motor M. The push-up lever 20 pushes up the copying paper loading plate 19 by rotating in the same direction linked to the rotation in the clockwise direction of the rotating shaft 20*a*. Further, the optimum height stated above is a height at which the pick-up roller 3 optimally presses against the uppermost surface of the copying paper P. This height is equal to the height at which one protruding portion 4*b* of the leading edge of a pick-up frame 4 axially supporting the pick-up roller 3 cuts off the light path of a photosensor 14.

The push-up means of the upper level feeding tray 121 comprise a copying paper loading plate 119 inside the lower portion of this tray and a push-up lever 4*c* underneath this plate. The copying paper loading plate 119 is pushed up and maintained at an optimum height by the push-up lever 4*c* which passes through a long opening provided on the bottom of the lower level feeding tray 121 (not shown in the figure) (long opening extending in the left to right direction of FIG. 1) and is made to rotate in the clockwise direction. This push-up lever 4*c* is integrally fixed to the upper surface of the pick-up frame 4 of the lower level feeding tray 21. Namely, the push-up lever 4*c* rotates in relation to the rotation of the pick-up frame 4. Further, the optimum height stated above is a height at which the pick-up roller 103 optimally presses against the uppermost surface of the copying paper P. This height is equal to the height at which one protruding portion 104*b* of the leading edge of a pick-up frame 104 axially supporting the pick-up roller 103 cuts off the light path of a photosensor 114.

Figure 2:
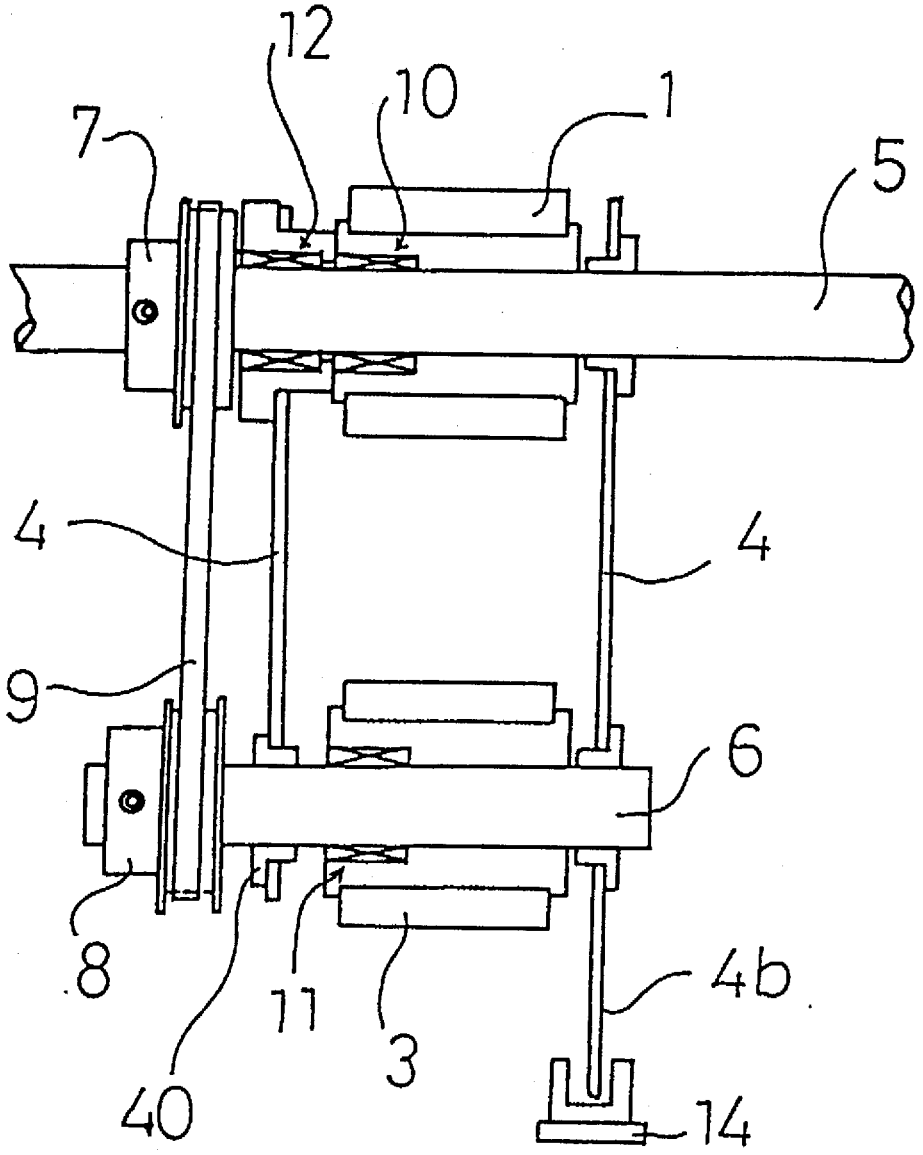
FIG. 2 shows a detailed view of the pick-up frame 4 of the feeder of the first embodiment and the drive transmission mechanism of the group of paper feeding rollers supported by this pick-up frame 4.

FIG. 2 is a top view showing the details of the pick-up frame 4 shown in FIG. 1 and the details of the drive transmission mechanism of the group of paper feeding rollers supported by this pick-up frame 4.

The pick-up roller 3 for the lower level feeding tray 21 is mounted on the peripheral surface of a pick-up roller shaft 6 via a one-way clutch 11 provided inside the roller. This pick-up roller shaft 6 is supported so it can rotate by a bearing 40 fixed to the pick-up frame 4.

Moreover, a supply roller 1 for the lower level feeding tray 21 is mounted on the peripheral surface of a supply roller shaft 5 via a one-way clutch 10 provided inside the roller. This supply roller shaft 5 is supported so it can rotate by a bearing fixed to the side panel of the image forming apparatus main body (not shown in the figure). Further, on the peripheral surface of this supply roller shaft 5, the pick-up frame 4 is mounted via an electromagnetic clutch 12.

In the above construction, the drive transmission direction of the one-way clutches 10, 11 is arranged in identical directions. Also, a pulley 7 is fixed to the supply roller shaft 5 and a pulley 8 is fixed to the pick-up roller shaft 6. Furthermore, pulley 7 and pulley 8 are linked to each other by a drive belt 9.

Therefore, when the supply roller shaft 5 is rotated in the drive transmission direction (forward direction) of the one-way clutch 10 with the electromagnetic clutch 12 in an OFF (cut off) state, the supply roller 1 also rotates in the same direction. In addition, the pick-up roller shaft 6 which is linked by the drive belt 9 and the pick-up roller 3 which is linked to this pick-up roller shaft 6 by the one-way clutch 11 also rotate in the same direction. Further, when the supply roller shaft 5 is rotated in the cut off direction (reverse direction) of the one-way clutch 10 with the electromagnetic clutch 12 in an ON (transmit) state, the pick-up frame 4 linked by the electromagnetic clutch 12 also rotates in the cut off direction (reverse direction) stated above. However, the supply roller 1 and the pick-up roller 3 do not rotate because both one-way clutches 10, 11 are in a cut off state. Furthermore, in this embodiment, the drive transmission direction of the one-way clutches 10, 11 or namely, the rotation direction of the supply roller 1 and the pick-up roller 3 is set to the counterclockwise direction in FIG. 1 and, conversely, the cut off direction of the one-way clutches 10, 11 or namely, the rotation direction of the pick-up frame 4 is set to the clockwise direction in FIG. 1.

Further, the separation roller 2 is linked to said supply roller shaft 5 by a gear and is constructed such that, at the position where the peripheral surface of the supply roller 5 and the peripheral surface of the separation roller 2 come into contact, both peripheral surfaces move in opposite directions. As shown in FIG. 1, this separation roller 2 is mounted to a separation roller frame 22 by a shaft 2*a* and one edge of this separation roller frame 22 is supported by the side panel of the image forming apparatus main body (not shown in the figure) via a separation roller frame shaft 22*a* and a spring 23 applies a force at the other edge in the upward direction. Consequently, an adequate manipulative pressure is always applied between the supply roller 1 and the separation roller 2.

Furthermore, the mechanism (not shown in figure) to drive the group of paper feeding rollers (pick-up roller 103, supply roller 101, separation roller 102) for the upper level feeding tray 121 is almost identical to the mechanism to drive the group of paper feeding rollers (pick-up roller 3, supply roller 1, separation roller 2) for the lower level feeding tray 21 stated previously with the only differing point being the lack of an electromagnetic clutch 12. Namely, because the upper level feeding tray 121 is the uppermost level feeding tray in this embodiment, there are no other feeding trays above it thus, there is also no push-up lever that should be extending from the upper portion of the pick-up frame 104. Therefore, an electromagnetic clutch that should link the pick-up frame 104 to the supply roller shaft 101 is not provided as well.

Figure 5:
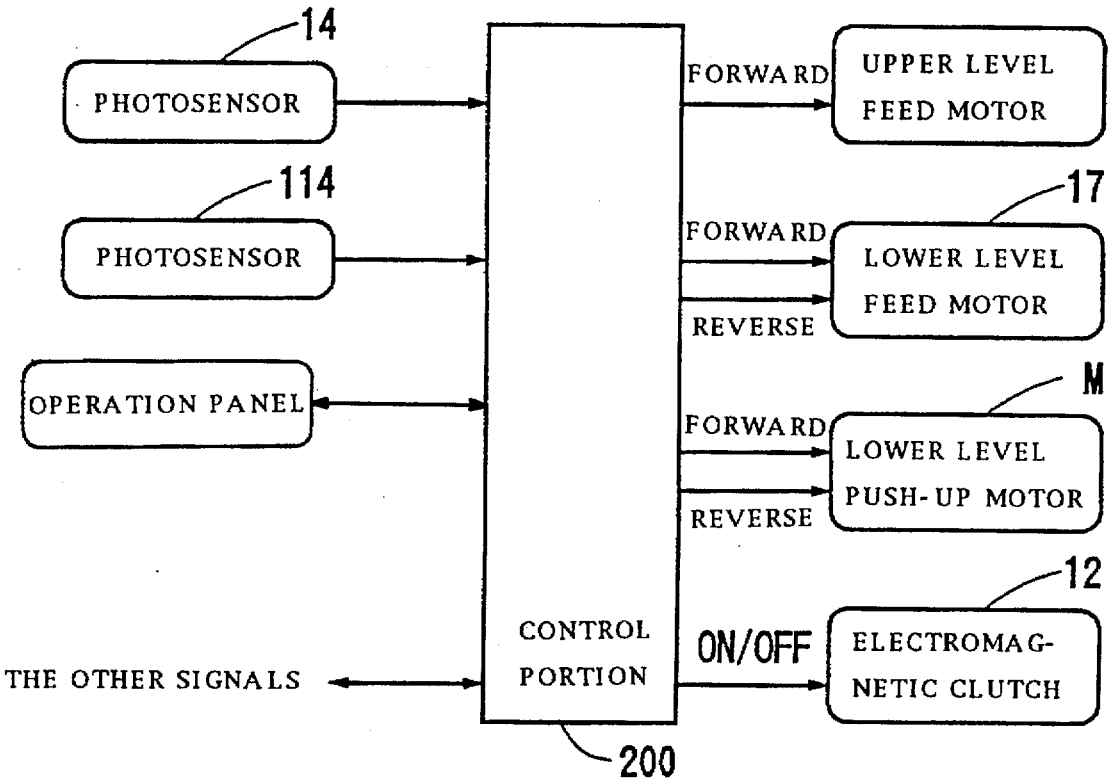
FIG. 5 is an explanatory view showing signals input and output to a control portion of an image forming apparatus to which the feeder of the first embodiment is connected.

FIG. 5 is an explanatory view showing signals related to the feeder of this embodiment which are input and output to a control portion of the image forming apparatus (not shown in figure) to which the feeder of this embodiment is connected. In FIG. 5 detection signals of the photosensors 14, 114 are input to the control portion 200 of the image forming apparatus from the feeder of this embodiment. Further, based on the detection signals from the feeder of this embodiment or signals based on instructions input by the operator in the image forming apparatus main body, control signals are output from the control portion 200 to each drive motor and electromagnetic clutch of the feeder of this embodiment. Various types of signals to operate the image forming apparatus itself are input and output to the control portion 200 in addition to the signals mentioned above, however, since they are not related to this invention, their description is omitted.

Next, the operation of the paper feeder of this embodiment will be described.

In the image forming apparatus to which the feeder of this embodiment is connected, when the operator inputs instructions to select the lower level feeding tray 21, the lower level push-up motor M is made to rotate in the clockwise direction (forward direction) by control signals from the control portion 200 (see FIG. 5). Thereby, the rotating shaft 20*a* rotates in the clockwise direction and, linked to this, the push-up lever 20 also rotates in the clockwise direction pushing up the copying paper loading plate 19. At this time, the electromagnetic clutch 12 is OFF and the pick-up roller 3 supported by the pick-up frame 4 makes contact with the upper surface of the copying paper P by its own weight (see FIG. 1).

The copying paper loading plate 19 is pushed up in this way and, as a result, when the photosensor 14 detects a protruding portion 4*b* of the leading edge of the pick-up frame 4, the lower level push-up motor M is stopped and the copying paper loading plate 19 is maintained at that height. At that time, the pick-up roller 3 is brought into contact with the upper surface of the copying paper P at an optimum pressure. Further, when the paper feed reduces the copying paper, the pick-up frame 4 drops down and the protruding portion 4*b* stated above becomes undetectable by the photosensor 14, the lower level push-up motor M will be made to rotate in the forward direction again pushing up the copying paper loading plate 19. Thereupon, as in the same manner as described above, the copying paper loading plate 19 will be stopped at the height the protruding portion 4*b* is detected by the photosensor 14 and maintained at that height. By repeating this action, the copying paper loading plate 19 is always maintained at a height obtained by an optimum feed pressure of pick-up roller 3.

Figure 3A:
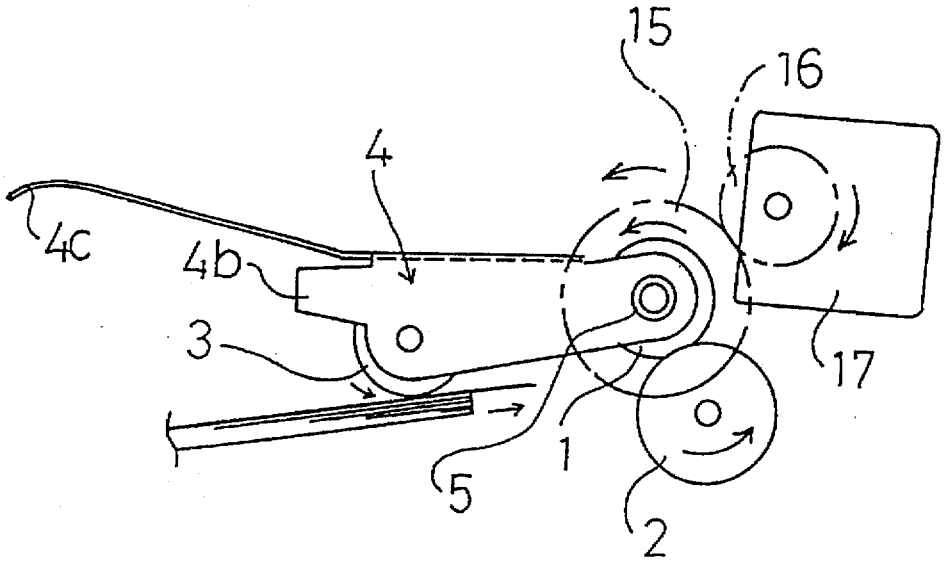
FIG. 3*a* is a model view showing the pick-up frame 4 and the drive state of the group of paper feeding rollers supported by this pick-up frame 4 in the case when lower level feeding tray 21 is selected

When the lower level push-up motor M is stopped, next, a lower level feed motor 17 is made to rotate in the clockwise direction (forward direction) with the electromagnetic clutch 12 in an OFF state in response to control signals being sent at each feed timing from the control portion 200. This rotation is transmitted to the supply roller shaft 5 via a gear 16 and a gear 15. The supply roller 1 linked to the supply roller shaft 5 via the one-way clutch 10, pick-up roller shaft 6 linked to the supply roller shaft 5 via the drive belt 9, and the pick-up roller 3 linked to the pick-up roller shaft 6 via the one-way clutch 11 are all rotated in the counterclockwise direction by this action. In this way the copying paper P inside the lower level feeding tray 21 is fed out from the uppermost layer in order sheet by sheet (see FIG. 3*a*).

Figure 3B:
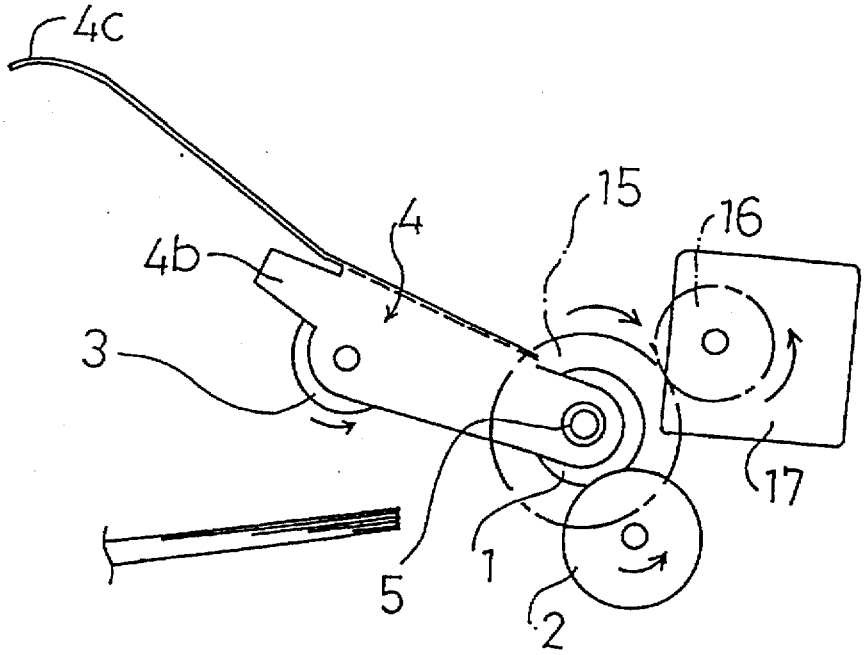
FIG. 3*b* is a model view showing the pick-up frame 4 and the drive state of the group of paper feeding rollers supported by this pick-up frame 4 in the case when upper level feeding tray 121 is selected.
Figure 4:
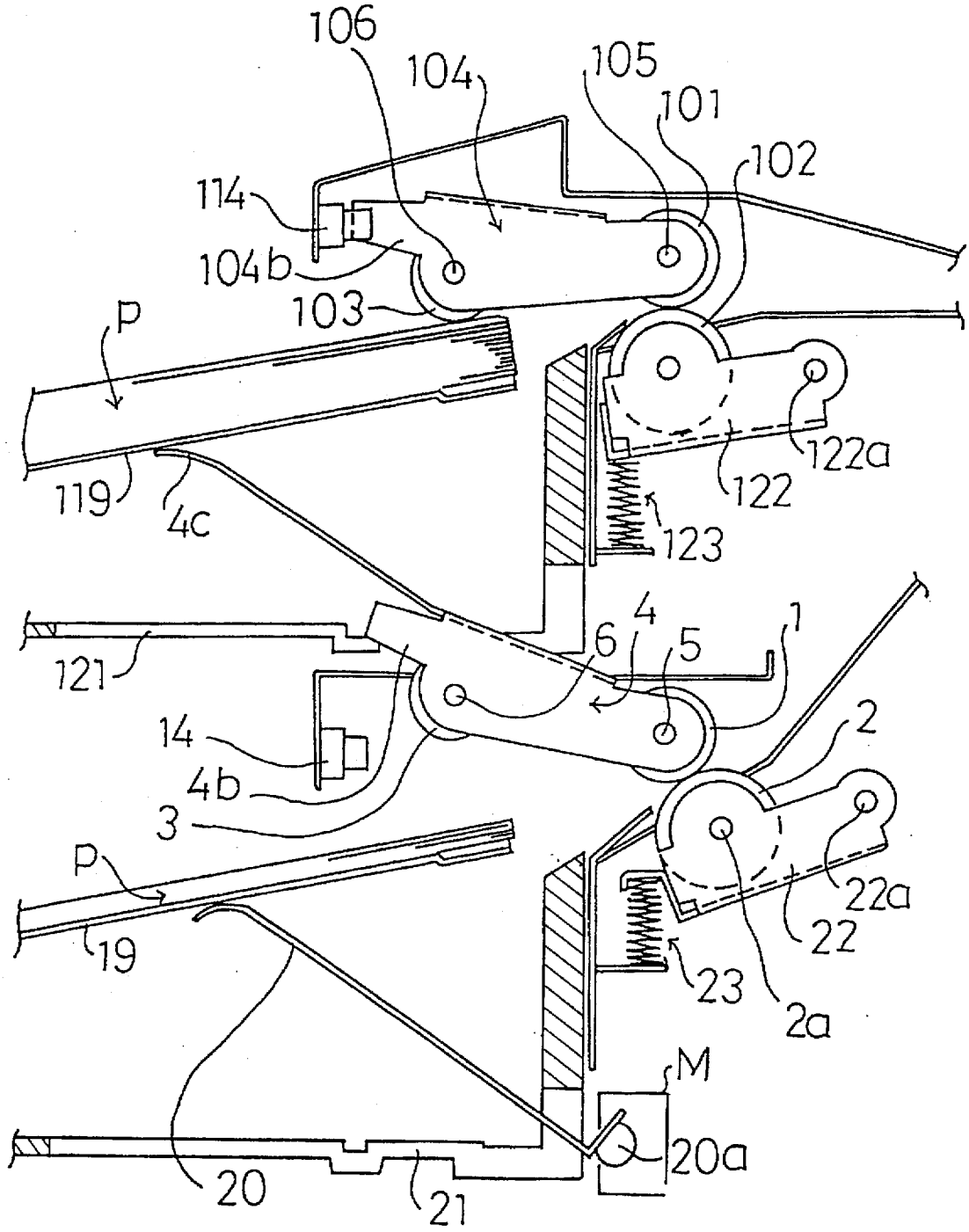
FIG. 4 is a model view showing the overall construction of the paper feeder of the first embodiment. This figure shows a state in which upper level feeding tray 121 is selected.

On the other hand, when the operator inputs instructions to select the upper level feeding tray 121 in the image forming apparatus, control signals are output from the control portion 200 and at first, the electromagnetic clutch 12 turns ON and then the lower level feed motor 17 and pick-up frame 4 are linked to each other via the supply roller shaft 5. Thereafter, the lower level feed motor 17 is made to rotate in the counterclockwise direction (reverse direction). This rotation is transmitted to the pick-up frame 4 via the gear 16 and the gear 15 and further via supply roller shaft 5 rotating the pick-up frame 4 in the clockwise direction (see FIG. 3*b*). Consequently, the push-up lever 4*c* integrated with the pick-up frame 4 rotates in the clockwise direction pushing up the copying paper loading plate 119. At this time, the pick-up roller 103 supported by the pick-up frame 104 makes contact with the upper surface of the copying paper P by its own weight (see FIG. 4).

The copying paper loading plate 119 is pushed up in this way and, as a result, when the photosensor 114 detects a protruding portion 104*b* of the leading edge of the pick-up frame 104, the lower level feed motor 17 is stopped with the electromagnetic clutch 12 in an ON state and the copying paper loading plate 119 is maintained at that height. At that time, the contact pressure of the pick-up roller 103 to the upper surface of the copying paper P is already adjusted such that it becomes optimum. Further, when the paper feed reduces the copying paper, the pick-up frame 104 drops down and the protruding portion 104*b* stated above becomes undetectable by the photosensor 114, the lower level feed motor 17 will be made to rotate in the counterclockwise direction (reverse direction) again pushing up the copying paper loading plate 119. Thereupon, as in the above description of the copying paper loading plate 19 of the lower level feeding tray 21, the loading plate will be maintained at an optimum height by repeatedly rising and falling.

When the lower level feed motor 17 is stopped, next, an upper level feed motor (not shown in figure, see FIG. 5) is rotated in the clockwise direction (forward direction) in response to control signals being sent at each feed timing from the control portion 200. This rotation is transmitted to the supply roller shaft 105 identical to the feed from the lower level feeding tray 21 stated above and the supply roller 101 and the pick-up roller 103 are both rotated in the counterclockwise direction. In this way the copying paper P inside the upper level feeding tray 121 is fed out from the uppermost layer in order sheet by sheet.

Next, when instructions to select the lower level feeding tray 21 are issued again in the image forming apparatus, the lower level push-up motor M is made to rotate in the counterclockwise direction (reverse direction) and the push-up lever 20 is pushed down for a moment thereafter, identical to the above, the copying paper loading plate 19 is risen to an optimum position and the paper feed operation is carried out.

In other words, because the paper feeds after the copying paper loading plate 19 was lowered for a moment, the protruding portion 4*b* can be prevented from rising higher than the photosensor 14 even when copying paper was supplied to the lower level feeding tray 21.

Thus, in this embodiment, after integrally constructing the push-up lever 4*c* for the upper level feeding tray 121 and the pick-up frame 4 that supports the group of paper feeding rollers for the lower level feeding tray 21 linking the group of paper feeding rollers and the paper feed motor 17 to each other by the one-way clutches 10, 11 such that drive force can be transmitted in one direction only and, by linking the pick-up frame 4 and the paper feed motor 17 to each other by the electromagnetic clutch 12 so drive force can be transmitted or cut off freely, the push-up lever 4c and the group of paper feeding rollers are selectively driven by a single paper feed motor 17 thereby reducing the number of motors.

Furthermore, although a feeder with a two-level feeding tray is described as an example in this embodiment, the construction of this embodiment can be applied to a feeder with three or more feeding trays as well. Even further, when the electromagnetic clutch 12 turns ON and the pick-up frame 4 is set at an intermediate position between the position shown in FIG. 1 and the position shown in FIG. 4 in a feed standby state (no-feed state), thereafter, a state in which paper can be fed can be switched to in a short time even if either feeding tray is selected.

Figure 6:
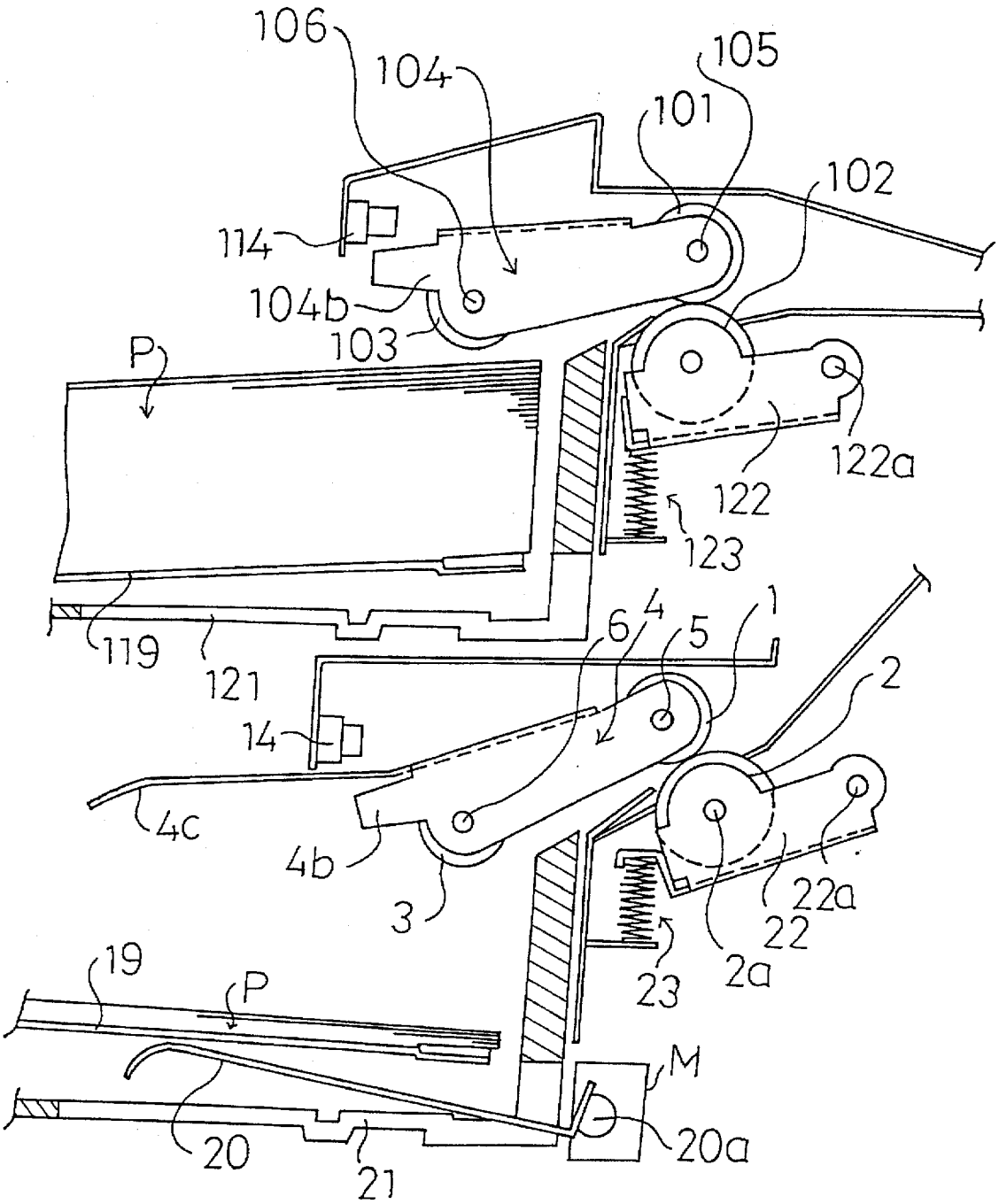
FIG. 6 is a model view showing the overall construction of the feeder of the first embodiment. This figure shows a paper feed standby condition.

FIG. 6 shows the above-mentioned standby state. The control to stop the pick-up frame 4 at the above-mentioned standby position can be conceived to be, for example, one in which the pick-up frame 4 is stopped after the pick-up frame 4 is rotated in the counterclockwise direction by timer control for a fixed time after it is either raised or lowered for a moment and the protruding portion 4b is detected by the photosensor 14.

Moreover, in the above embodiment, by changing the rotation direction of the paper feed motor 17, the rotation direction of the push-up ever 4c and the group of paper feeding rollers is reversed. However, the rotation direction of both can also be reversed by not changing the rotation direction of the paper feed motor 17 and changing the mechanism to transmit drive power.

Figure 7:
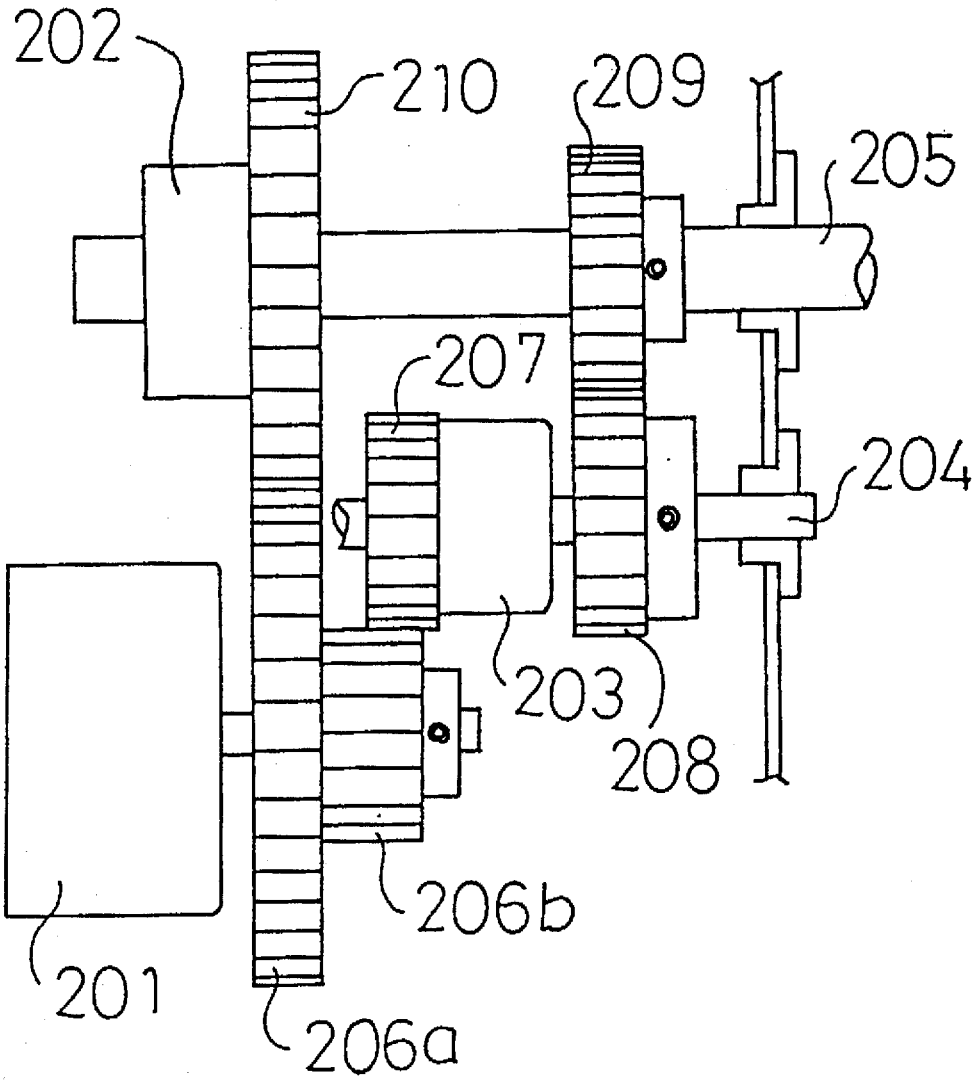
FIG. 7 shows one example of the construction of the drive transmission mechanism applied to the feeder of the first embodiment.

FIG. 7 is a top view showing one example of the construction of the above-mentioned drive transmission mechanism.

In the figure, 201 is the drive motor, 202, 203 are electromagnetic clutches, 204 is an intermediate shaft, 205 is a supply roller shaft and 206 to 210 are gears.

The gears 206a and 206b rotate coaxially with the motor 201 transmitting drive force to gears 210 and 207, respectively. The gear 210 and the supply roller shaft 205 are linked to each other by the electromagnetic clutch 202 so drive force can be transmitted or cut off freely. Conversely, the gear 207 and the intermediate shaft 204 are linked to each other by the electromagnetic clutch 203 so drive force can be transmitted or cut off freely. Further, the supply roller shaft 205 and the intermediate shaft 204 are linked to each other by the gears 208, 209 and are arranged so they always rotate in opposite directions to each other.

In the above-mentioned construction, when the motor 201 is made to rotate as the electromagnetic clutch 202 turns ON (transmit) and the electromagnetic clutch 203 turns OFF (cut off), drive force is transmitted to the supply roller shaft 205 by the gears 206a, 210 and the supply roller shaft 205 rotate in the direction opposite to the rotation direction of the motor 201. At this time, although the gear 207 rotates after the drive force is transmitted from the gear 206b, the intermediate shaft 204 does not rotate because the electromagnetic clutch 203 is OFF.

On the other hand, when the motor 201 is made to rotate as the electromagnetic clutch 202 turns OFF (cut off) and the electromagnetic clutch 203 turns ON (transmit), drive force is transmitted to the intermediate shaft 204 via the gears 206b, 207 and the intermediate shaft 204 rotates in the direction opposite to the rotation direction of the motor 201. Drive force is further transmitted by the gears 208, 209 to the supply roller shaft 205 from the intermediate shaft 204 to rotate the supply roller shaft 205 in the same direction as the rotation direction of the motor 201. At this time, although the drive force is transmitted from the gear 206a to rotate the gear 210 in the direction opposite to the rotation direction of the motor 201, the above-mentioned drive force is not transmitted to the supply roller shaft 205 because the electromagnetic clutch 202 is OFF.

In this way, according to the drive transmission mechanism described above, the rotation direction of the supply roller shaft can be controlled to freely switch between forward and reverse directions without changing the rotation direction of the motor. Therefore, by using the above-mentioned drive transmission mechanism to transmit drive force from the lower level paper feed motor 17 of the feeder of said embodiment to the supply roller shaft 5, it becomes possible to control the rotation directions of the push-up lever 4c and the group of paper feeding rollers to rotate in the opposite direction without changing the rotation direction of the lower level paper feed motor 17.

Moreover, in the construction of the feeding tray of the above embodiment, to control the rotation direction of the push-up lever 4c and the group of paper feeding rollers to rotate in the opposite direction is necessary to realize the push-up function and feeding function.

Next, referring to FIG. 8 and FIG. 9, a second embodiment of this invention will be described.

Identical to the feeder of the first embodiment, the paper feeder of this embodiment comprises two levels of upper and lower paper feeding trays in which are loaded various different sizes of copying paper and is used by connecting it to an image forming apparatus such as a copying machine.

Although the construction of the paper feeder of this embodiment is almost identical to the feeder of the first embodiment, the only differing point being a push-up means for each feeding tray that is driven by a motor that drives the group of paper feeding rollers for said feeding trays. In other words, in the feeder of the first embodiment above, the push-up means for the feeding tray on the upper level is driven by the motor that drives the group of paper feeding rollers on the immediate lower level feeding tray of the above-mentioned feeding tray on the upper level. However, in the feeder of this embodiment, this means is driven by the motor that drives the group of paper feeding rollers for the feeding tray on the upper level.

Figure 8:
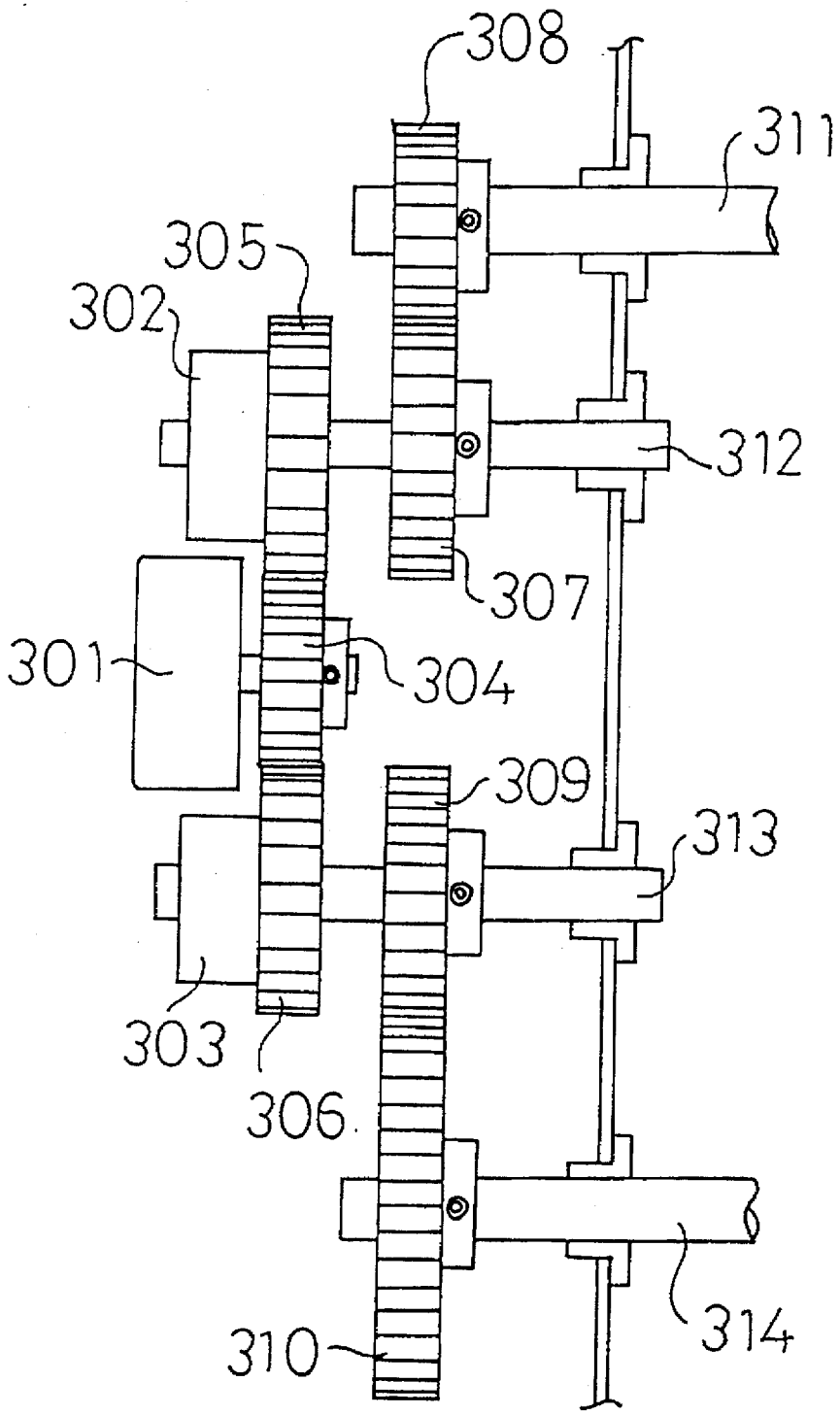
FIG. 8 shows one example of the construction of the drive transmission mechanism applied to the paper feeder of the second embodiment.

FIG. 8 is a side view showing the construction of the drive transmission mechanism applied to the paper feeder of this embodiment.

In the figure, 301 is the drive motor, 302, 303 are electromagnetic clutches, 304 to 310 are gears, 311 is a supply roller shaft, 312, 313 are intermediate shafts and 314 is a push-up lever shaft.

The gear 304 rotates coaxially with the motor 301 transmitting drive force to the gears 305 and 306. The gear 305 and the intermediate shaft 312 are linked to each other by the electromagnetic clutch 302 so drive force can be transmitted or cut off freely. Conversely, the gear 306 and the intermediate shaft 313 are linked by the electromagnetic clutch 303 so drive force can be transmitted or cut off freely. Further, the supply roller shaft 311 and the intermediate shaft 312 are linked to each other via the gears 307, 308 and are arranged so they always rotate in opposite directions to each other. Conversely, the push-up lever shaft 314 and the intermediate shaft 313 are linked to each other via the gears 309, 310 and are arranged so they always rotate in opposite directions to each other as well.

In the above-mentioned construction, if the electromagnetic clutch 302 turns ON (transmit) and the electromagnetic clutch 303 turns OFF (cut off), the drive force of the motor 301 can be transmitted to the supply roller shaft 311 only and in contrast to this, if the electromagnetic clutch 302 turns OFF (cut off) and the electromagnetic clutch 303 turns ON (transmit), the drive force of the motor 301 can be transmitted to the push-up lever shaft 314 only.

Figure 9:
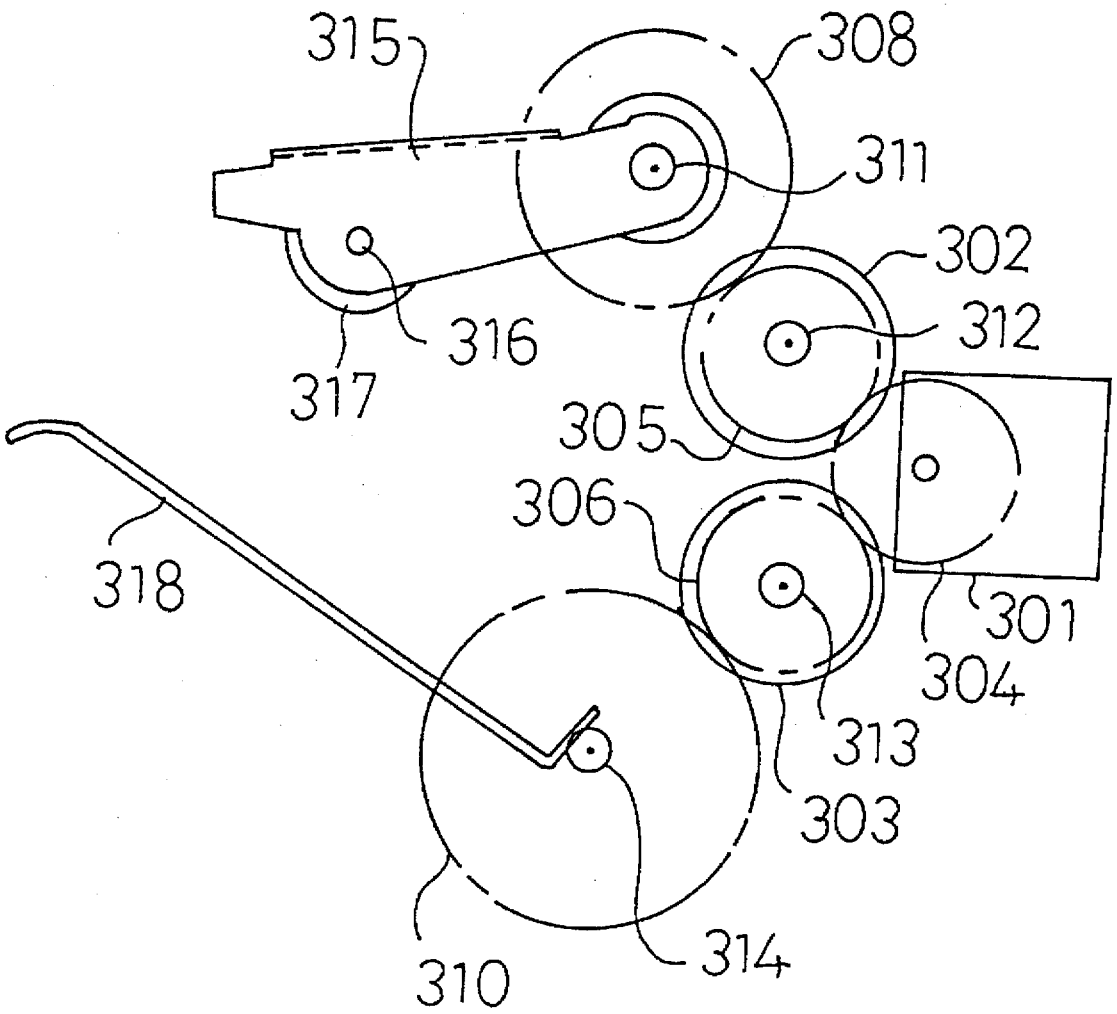
FIG. 9 is a model view showing one portion of the construction of the feeder of the second embodiment.

FIG. 9 is a front view showing one portion of the construction of the paper feeder of this embodiment in which the drive transmission mechanism shown in FIG. 8 is used. Further, the overall construction of the feeder of this embodiment is, as stated above, almost identical to the feeder of the first embodiment thus, figures and description are omitted.

In the figure, identical numbers to FIG. 8 are attached. 316 is a pick-up roller shaft which is set to rotate in the same direction as the supply roller shaft 311 by drive force from the supply roller shaft 311 being transferred by the drive transmission mechanism (not shown in figure). 317 is a pick-up roller, is mounted on the peripheral surface of the pick-up roller shaft 316 and rotates in relation to the rotation of the pick-up roller shaft 316. The pick-up roller shaft 317 and the supply roller shaft 311 are both supported by a pick-up frame 315.

318 is a push-up lever. The push-up lever 318 is fixed to a push-up lever shaft 314 and rotates in the same direction in relation to the rotation of the push-up lever shaft 314. The above-mentioned push-up lever 318 raises and lowers the copying paper loading plate (not shown in figure) of the feeding tray in which copying paper which should be fed out by said pick-up roller 317 is loaded.

When paper is fed in the above-mentioned construction, at first, the motor 301 is rotated in the clockwise direction (forward direction) in FIG. 9 rotating the push-up lever shaft 314 in the clockwise direction via the gears 304, 306, 310, etc. This action causes the push-up lever 318 to rotate in the clockwise direction pushing up the copying paper loading plate (not shown in figure). At this time, the electromagnetic clutch 303 turns ON (transmit) and the electromagnetic clutch 302 turns OFF (cut off) and the drive force is not transmitted to the supply system including the supply roller shaft 311 and pick-up roller shaft 317.

When the copying paper loading plate is pushed up and is stopped at an optimum height by the mechanism identical to the feeder of the first embodiment, the motor 301 is stopped for a moment and the electromagnetic clutch 303 turns OFF (cut off) and the electromagnetic clutch 302 turns ON (transmit) thereafter, the motor is rotated in the counterclockwise direction rotating the supply roller shaft 311 in the counterclockwise direction via the gears 304, 305, 308.

This action rotates the pick-up roller 317 in the counterclockwise direction and feeds out copying paper loaded on the copying paper loading plate (not shown in figure) from the uppermost layer in order sheet by sheet. At this time, the electromagnetic clutch 303 is in an OFF state thus, no drive force is transmitted to the push-up lever 318.

Furthermore, although in this embodiment a paper feeder having an upper/lower two-level feeding tray is described as an example, the construction of this embodiment can be applied to a feeder with one feeding tray or a feeder with three or more feeding trays.

Even further, although either of the two embodiments utilize the push-up means as a means to set the leading edge of copying paper in the tray at an optimum height, this invention can be applied even when a means to pull up the copying paper loading plate is used in place of the push-up means. For this case, it is preferable for the paper feed motor that drives the pull-up moans to be a feed motor for the paper feeding tray like the feeder of the second embodiment, not a feed motor for the immediate lower level feeding tray like the feeder of the first embodiment. Moreover, a feed motor for the immediate upper level feeding tray can be used.

As described above, according to the feeder of the first and second embodiments, the number of motors required in a sheet feeding apparatus can be reduced thereby lowering the cost and making the size of the feeder smaller.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A sheet feeding apparatus comprising:

a sheet storage means for storing sheets to be fed;

a positioning means for bringing the sheets stored in said sheet storage means to a sheet feeding position;

a feeding means for feeding, one by one, the sheets which are positioned at said sheet feeding position by said positioning means;

a motor;

an electromagnetic clutch which is switched between an energized state and a disenergized state and is connected to the motor so as to transmit the driving force of motor rotations in both forward and reverse directions in the energized state thereof to the positioning means so that the positioning means brings the sheets to the sheet feeding position and returns the sheets from the sheet feeding position; and a one-way clutch which is switched between an energized state and a disenergized state and is connected to the motor so as to transmit the driving force of motor rotations in either the forward or the reverse direction in the energized state thereof to the feeding means so that the feeding means feeds the sheet one by one.

2. A sheet feeding apparatus comprising:

a plurality of sheet trays each of which stores sheets to be fed;

a plurality of sheet positioning mechanisms corresponding to said sheet trays, which brings the sheets stored in said sheet trays to a sheet feeding position;

a plurality of sheet feeding mechanisms corresponding to said sheet trays, which feeds, one by one, the sheets positioned at said sheet feeding position by said positioning mechanisms;

a motor which is connected to and drives one of said sheet positioning mechanisms and one of the sheet feeding mechanisms, wherein the one sheet feeding mechanism corresponds to a sheet tray that is different from the sheet tray corresponding to the one sheet positioning mechanism.

3. A sheet feeding apparatus comprising:

an upper sheet tray which stores sheets to be fed;

a lower sheet tray which is located below the upper sheet tray and stores the sheets to be fed;

an upper positioning mechanism which brings the sheets stored in said upper sheet tray to a sheet feeding position;

a lower positioning mechanism which brings the sheets stored in said lower sheet tray to a sheet feeding position, an upper sheet feeding mechanism which feeds the sheet stored in said upper sheet tray;

a lower sheet feeding mechanism which feeds the sheet stored in said lower sheet tray;

a motor; and a driving means for transmitting the driving force of the motor to the upper positioning mechanism and the lower sheet feeding mechanism.

4. The sheet feeding apparatus as claimed in claim 3, wherein said upper sheet feeding mechanism is driven by another motor and said lower positioning mechanism is driven by further another motor.

5. The sheet feeding apparatus as claimed in claim 3, wherein each of said upper and lower sheet trays has a sheet lifting plate on which the sheets are placed;

each of said upper and lower positioning mechanisms has a lifting lever which lifts up the said lifting plate to locate the sheet at the sheet feeding position, said lifting lever being located below the lifting plate to be lifted up thereby, and each of said upper and lower sheet feeding mechanisms has a feed roller which is in contact with the sheet positioned at the sheet feeding position.

6. A sheet feeding apparatus comprising:

a sheet tray which stores sheets to be fed;

a lift mechanism which lifts the sheets stored in the sheet tray to a sheet feeding position;

a feeder which feeds the sheets positioned at said sheet feeding position by said lift mechanism one by one;

a motor;

a first clutch which is connected to the motor and is energized when the motor rotates in one direction so as to transmit the driving force of the motor to the lift mechanism; and a second clutch which is connected to the motor and is energized when the motor rotates in another direction so as to transmit the driving force of the motor to the feeder.

7. A sheet feeding apparatus comprising:

a first sheet tray which stores sheets to be fed;

a second sheet tray which is located below said first tray and stores sheets to be fed;

a first lift lever which lifts the sheets stored in the first tray to a sheet feeding position;

a first rotative member which rotates and feeds the sheets lifted by said first lift lever;

a second lift lever which lifts the sheets stored in the second tray to a sheet feeding position;

a second rotative member which rotates and feeds the sheets lifted by said second lift lever;

a first motor; and a gear train which transmits driving force of the motor to the first lift lever and the second rotative member to drive the first lift lever and the second rotative member.

8. The sheet feeding apparatus as claimed in claim 7 further comprising:

a second motor which drives the first rotative member; and a third motor which drives the second lift lever.

9. The sheet feeding apparatus as claimed in claim 7 further comprising a frame which is integrally formed with said first lift lever and rotatably holds said second rotative member.

10. A sheet feeding apparatus comprising:

an upper tray which stores sheets to be fed;

a lower tray which is located below said upper tray and stores sheets to be fed;

an upper lift lever which lifts the sheets stored in the upper tray to a sheet feeding position;

an upper rotative member which feeds the sheets lifted by said upper lift lever;

a lower lift lever which lifts the sheets stored in the lower tray to a sheet feeding position;

a lower rotative member which feeds the sheets lifted by said lower lift lever; and a frame which is integrally formed with the upper lift lever and rotatably holds the lower rotative member.

11. The sheet feeding apparatus as claimed in claim 10, wherein said frame moves upward to lift the sheet stored in the upper tray with the upper lift lever when the sheets stored in the upper tray are fed and moves downward to feed the sheets stored in the lower tray with the lower rotative member when the sheets stored in the lower tray are fed.

12. The sheet feeding apparatus as claimed in claim 11, wherein said frame is positioned at a neutral position where the upper lift lever and the lower rotative member are respectively retracted from the sheets stored in the upper and lower trays when the sheets in either the upper or the lower tray are not fed.

13. The sheet feeding apparatus as claimed in claim 12, wherein said frame and the lower rotative member are driven by only one motor.

14. A sheet feeding method comprising steps of:

selecting an upper tray or a lower tray;

when the upper tray is selected, transmitting driving force of a first motor to a upper sheet positioning mechanism so as to bring sheets stored in the upper tray to a sheet feeding position; and transmitting driving force of a second motor to an upper sheet feeding mechanism so as to feed the sheets positioned at the sheet feeding position; and when the lower tray is selected, transmitting driving force of a third motor to a lower sheet positioning mechanism so as to bring sheets stored in the lower tray at a sheet feeding position; and transmitting driving force of the first motor to a lower sheet feeding mechanism so as to feed the sheets positioned at the sheet feeding position.

15. The sheet feeding method as claimed in claim 14, wherein the first motor rotates in one direction when the sheets stored in the upper tray brings to the sheet feeding position and rotates in another direction when the sheets stored in the lower tray is fed.

* * * * *